US007419242B2

(12) United States Patent
Nellen

(10) Patent No.: US 7,419,242 B2
(45) Date of Patent: Sep. 2, 2008

(54) PRINTHEAD CARRIAGE

(75) Inventor: Wilhelmus H. J. Nellen, Venlo (NL)

(73) Assignee: OCE-Technologies B.V., Venlo (NL)

( * ) Notice: Subject to any disclaimer, the term of this patent is extended or adjusted under 35 U.S.C. 154(b) by 429 days.

(21) Appl. No.: 11/318,454

(22) Filed: Dec. 28, 2005

(65) Prior Publication Data

US 2006/0139400 A1 Jun. 29, 2006

(30) Foreign Application Priority Data

Dec. 29, 2004 (EP) ..... 04107044

(51) Int. Cl.
*B41J 23/00* (2006.01)
*B41J 29/13* (2006.01)

(52) U.S. Cl. ..... 347/37; 347/108

(58) Field of Classification Search ..... 347/49, 347/74, 37, 108; 101/382.1
See application file for complete search history.

(56) References Cited

U.S. PATENT DOCUMENTS 5,241,325 A * 8/1993 Nguyen ..... 347/49
5,477,254 A * 12/1995 Stephens ..... 347/74
5,887,523 A * 3/1999 Leader et al. ..... 101/382.1

FOREIGN PATENT DOCUMENTS

EP 0 693 382 A1 1/1996

* cited by examiner

*Primary Examiner*—Stephen D. Meier
*Assistant Examiner*—Carlos A Martinez, Jr.
(74) *Attorney, Agent, or Firm*—Birch, Stewart, Kolasch & Birch, LLP

(57) ABSTRACT

A printhead carriage including a body that is guided and driven for reciprocating movement in a printer, a mounting plate for a printhead assembly, and a suspension structure adjustably connecting the mounting plate to the body, the suspension structure having a framework of hinge plates having elastic hinges and at least one adjusting mechanism adapted to adjust the position of the mounting plate by elastically deflecting at least one of the hinges. An adjusting unit which provides for at least one degree of freedom of the mounting plate and includes two hinge plates that are connected to a common support point of the mounting plate and are oriented at right angles relative to one another, and the adjusting mechanism is adapted to push and/or pull one hinge plate in the longitudinal direction thereof, with the elastic deflection of at least one hinge of the other hinge plate.

10 Claims, 3 Drawing Sheets

PRINTHEAD CARRIAGE

This application claims priority to European Patent Application No. 04107044.2 filed on Dec. 29, 2004 in Europe, the entire contents of which is hereby incorporated by reference in its entirety.

BACKGROUND OF THE INVENTION

The present invention relates to a printhead carriage including a body that is guided and driven for reciprocating movement in a printer, a mounting plate for a printhead assembly, and a suspension structure adjustably connecting the mounting plate to the body, the suspension structure comprising a framework of hinge plates having elastic hinges that are formed by reduced-width portions of the hinge plates and at least one adjusting mechanism adapted to adjust the position of the mounting plate by elastically deflecting at least one of the hinges.

In a scanning-type printer, e.g. an ink jet printer, a printhead carriage is moved back and forth in a main scanning direction Y, so as to scan a recording medium that is advanced step-wise in a sub-scanning direction X over a print surface. For obtaining a good print quality, it is important that the mounting plate which carries the printheads is exactly adjusted relative to the print surface. For example, in an ink jet printer, the printheads comprise one or more arrays of nozzles from which ink droplets are ejected onto the recording medium at appropriate moments during the scan movement of the carriage, so that an image is formed on the recording medium. Accordingly, the mounting plate must be adjusted so that the flight distance of the ink droplets is identical for all nozzles. This means that the mounting plate should be held in a stable position so that it is exactly parallel to the print surface. Moreover, the angle of the nozzle array or arrays relative to the main scanning direction must be adjusted with a high degree of accuracy, e.g., to 90°.

If the carriage carries a plurality of printheads, as is the case for example in a multi-color printer, another problem may arise from the fact that the operation of the printheads is frequently accompanied by the generation of a considerable amount of heat, so that the mounting plate is subject to thermal expansion which may change the positions of the printheads relative to one another. This is particularly the case for a hot melt ink jet printer which operates with ink that is solid at room temperature, so that the printheads must be heated to a relatively high temperature, for example, 100° C. or more, in order to melt the ink. If the temperature of the mounting plate is uniform, the thermal expansion may be compensated for by appropriately controlling the timing at which the individual nozzles are energized. However, if the temperature distribution of the mounting plate is not uniform, it becomes difficult to compensate for the thermal expansion.

In order to achieve a high productivity of the printer, the carriage must be accelerated and decelerated at the beginning and at the end of each scan pass with a considerably high rate. As a result, considerable forces of inertia are generated which may cause the mounting plate to shift or to vibrate. It is therefore required that the suspension structure has a sufficient stiffness for stably holding the mounting plate in the desired position.

SUMMARY OF THE INVENTION

The present invention provides a printhead carriage in which the mounting structure has a simple construction but nevertheless is capable of stably holding the mounting plate in position with a high adjustment accuracy.

According to the present invention, a printhead carriage of the type indicated above is provided, wherein an adjusting unit for at least one degree of freedom of the mounting plate comprises two hinge plates that are connected to a common support point of the mounting plate and are oriented at right angles relative to one another, and an adjusting mechanism adapted to push and/or pull one hinge plate in a longitudinal direction thereof, with elastic deflection of at least one hinge of the other hinge plate.

The use of a framework of such hinge plates has the advantage that the mounting plate can stably be supported in the desired position, and the elasticity of the hinges may be utilized for a precise fine-adjustment of the mounting plate. The hinge plates are rigid in one direction, i.e., their longitudinal direction, but behave like leaf springs with a relatively high spring constant in a direction normal to the longitudinal direction and in the same plane of the hinge plate. Thus, a portion of the mounting plate that is connected to a hinge plate may be rigidly supported in the one direction and may be adjusted in the direction orthogonal to the said one direction.

This is particularly useful when an adjustment of the mounting plate is necessary in two or more degrees of freedom, because, then, the adjustment operations for the individual degrees of freedom will be uncoupled from one another.

The relatively high spring constant of the elastic hinges has the effect that the resonance frequency of the mounting plate will be high and will thus be sufficiently offset from the spectrum of exciting frequencies that are to be expected when the printer is operating. Thus, vibrations of the mounting plate can be successfully suppressed.

The elasticity of the hinges also permits the absorption of thermal expansions and contractions of the mounting plate. Another remarkable advantage results from the fact that the narrow hinge portions have a very low heat conductivity, even, for example, when the hinge plates are made of spring steel, so that a good thermal insulation of the mounting plate is achieved and dissipation of heat through the suspension structure is effectively suppressed. As a result, a uniform temperature profile of the mounting plate can be achieved, so that the compensation of thermal expansions is facilitated, and, in the case of a hot melt ink jet printer, losses of heat energy are reduced to a minimum.

An adjusting unit for two degrees of freedom may comprise two hinge plates connected to a common support point on the mounting plate and oriented at right angles relative to one another, and two independent adjusting mechanisms respectively associated with one of the two hinge plates and adapted to push and/or pull the same in its longitudinal direction. The adjusting mechanism preferably comprises a lever which is rigidly connected to the end of the hinge plate and is connected to a fixed point of the carriage body through an elastic hinge in the vicinity of said end of the hinge plate. The ends of the two hinge plates remote from the common support point are preferably connected through a link so as to form a triangular framework. Preferably, each hinge plate has two hinges located near opposite ends thereof. Similarly, the link forming the third side of the triangular frame may also have two hinges in the vicinity of its opposite ends.

Preferably, the mounting plate is a rectangular plate having two support points projecting from the shorter sides of the rectangle, and a third support point projecting from one of the longer sides of the rectangle. An adjusting unit may be associated with each of the three support points. Then, the adjustable degrees of freedom of the mounting plate may comprise the positions of the three support points in a direction Z normal to the plane of the mounting plate. These degrees of freedom permit a control of the distance between the mounting plate and the print surface of the printer as well as the parallelism between the mounting plate and the print surface. One of the three adjusting units may be one with two degrees of freedom, so that it is additionally possible to adjust the position of the associated support point in a direction X that is parallel to the side of the mounting plate from which this support point projects. An adjustment in the X-direction will cause the mounting plate to rotate about an axis normal to the plane of the mounting plate and thus permits a control of the skew angle of the mounting plate relative to the main scanning direction Y.

The carriage body may preferably have two cantilever arms which embrace the mounting plate and each of which carries one adjusting unit. The third adjusting unit may be attached to a side surface of the carriage body. Since the mounting plate and the printheads should be arranged in a short distance above the print surface of the printer, it is preferable that the two cantilever arms project downwardly from the body and hold the mounting plate at a level below the carriage body. The adjusting unit which is directly attached to a side face of the body may then be arranged such that one of its hinge plates projects downwardly from the body, whereas the second hinge plate extends along a side of the mounting plate. The second hinge plate may be rigidly supported at the body by connecting the free end thereof to the Vertex of a V-shaped configuration of two hinge plates, the upper ends of which are fixed at the body.

BRIEF DESCRIPTION OF THE DRAWINGS

A preferred embodiment of the present invention will now be explained in conjunction with the drawings, wherein.

DETAILED DESCRIPTION OF THE INVENTION

Figure 1:
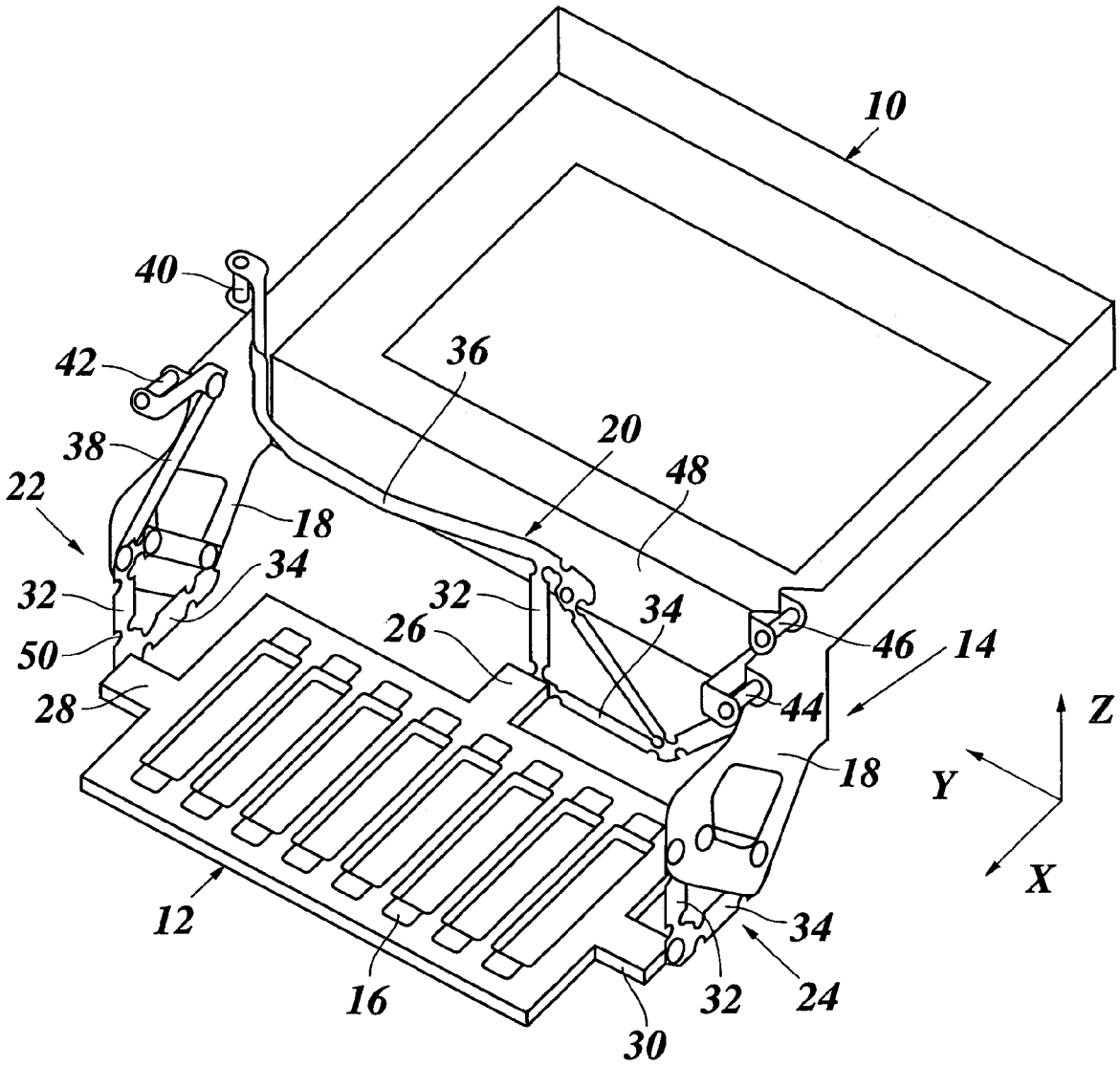
FIG. 1 is a simplified perspective view of a printhead carriage according to the present invention.

The printhead carriage shown in FIG. 1 comprises a body 10, a printhead mounting plate 12 made of metal, and a suspension structure 14 which adjustably connects the mounting plate 12 to the body 10.

As is commonly known in the art, the body 10 is guided on a guide rail (not shown) which extends in Y-direction of a Cartesian coordinate system X, Y, Z shown in FIG. 1. The mounting plate 12 has eight sockets 16 adapted to accommodate a corresponding number of ink jet printheads (not shown). The printheads, e.g., hot-melt ink jet printheads, will thus be held in a position in which downwardly directed nozzles of the printheads, which all lie in a common plane, will face a print surface (not shown) of the printer, with only a small gap being formed between the plane of the nozzles and the surface of a recording medium that is supported on the print surface.

The suspension structure 14 is formed by two cantilever arms 18 of the body 10 and three adjusting units 20, 22, 24 which connect the body 10 and the cantilever arms 18, respectively, to three support points 26, 28, 30 which project laterally from the mounting plate 12. The adjusting unit 20 serves to finely adjust the Z-position of the support point 26 but holds this support point rigidly in the Y-direction. Similarly, the adjusting unit 22 serves to adjust the Z-position of the support point 28 but holds this support point rigidly in the X-direction. The adjusting unit 24 is adapted for independent adjustment of the support point 30 in both, X- and Z-directions. Since the support point 28 is essentially fixed in X-direction, adjustment of the support point 30 in X-direction will cause the mounting plate 12 to rotate in the X-Y-plane.

The adjusting units 20 and 22 each comprise a vertically oriented hinge plate 32 and a horizontally oriented hinge plate 34 that are connected to the common support point 26 and 28, respectively. Further, each of these two adjusting units includes a lever 36 and 38, respectively, that is connected to the top end of the vertical hinge plate 32 and the free end of which is adjustable relative to the body 10 by means of a set-screw assembly 40, 42. The third adjusting unit 24 has the two hinge plates 32, 34 and two set-screw assemblies 44, 46.

Figure 2:
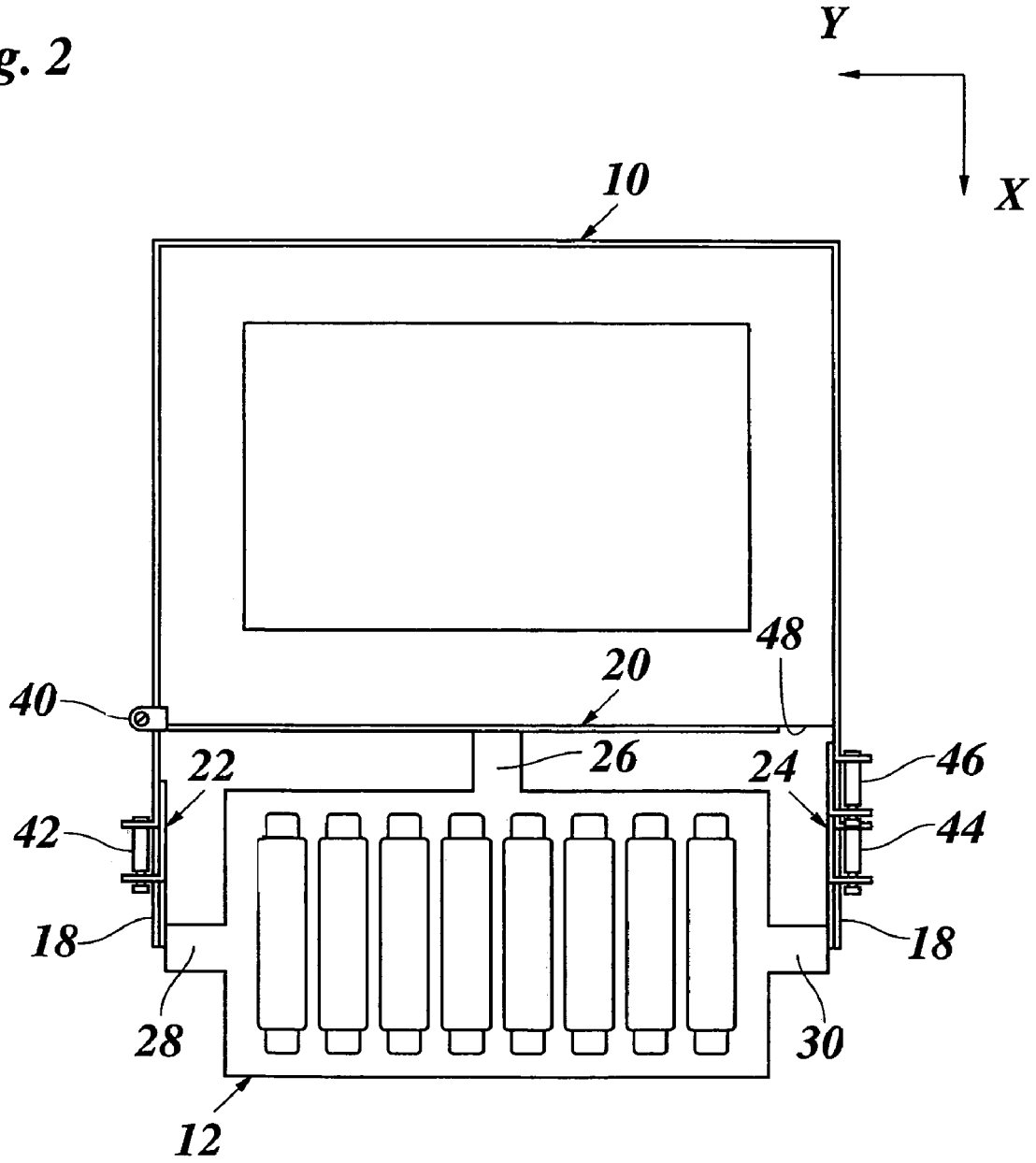
FIG. 2 is a plan view of the carriage.

As can be seen more clearly in FIG. 2, the mounting plate 12 has the shape of an elongated rectangle that is embraced by the two cantilever arms 18 to which the adjusting units 22 and 24 are attached. The corresponding support points 28 and 30 are arranged exactly opposite to one another. The third support point 26 projects from the center of one of the longer sides of the mounting plate 12, and the associated adjusting unit 20 is attached to a side face 48 of the body 10.

Figure 3:
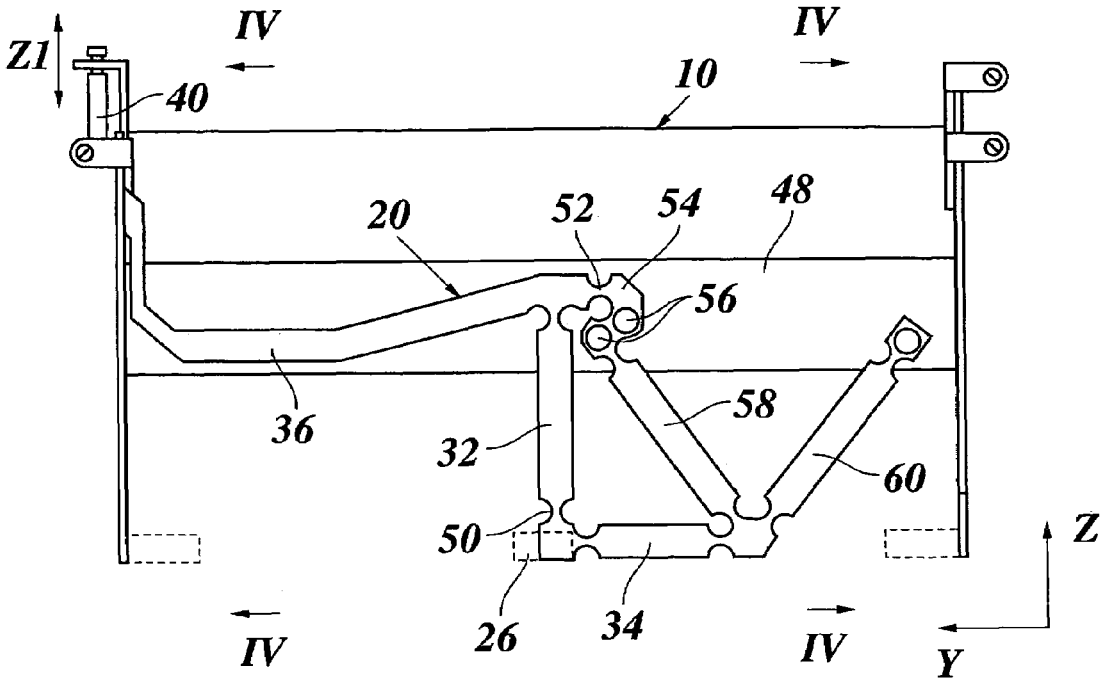
FIG. 3 is a front view of the carriage.

The detailed construction of the adjusting unit 20 will now described in conjunction with FIG. 3. The hinge plate 32 is an elongated plate of spring steel the width of which is locally reduced by a pair of opposed semi-circular cutouts, so that the portion of the plate remaining between the cutouts may serve as an elastic hinge 50. The plate 32 has two such hinges, one near the bottom end which is fixed at the support point 27 and another one near the top end which is connected to the lever 36. This lever 36 is itself configured as a hinge plate and has a hinge 52 in an end portion which slightly projects beyond the hinge plate 32. The hinge 52 connects the lever 36 to a base plate 54 that is rigidly attached to the front or side face 48 of the body 10 at two fixation points 56.

The horizontal hinge plate 34 has a configuration which corresponds to that of the vertical hinge plate 32. The end of the hinge plate 34 remote from the support point 26 is connected through one of its hinges to the vertex of a V-shaped structure formed by two hinge plates 58 and 60. The hinge plate 58 is connected to the base plate 54, and the hinge plate 60 is fixedly attached to the front or side face of the body 10. Thus, the hinge plates 32, 34, 58 and 60 and the base plate 54 together with the end portion of the lever 36 form a relatively rigid framework made up of two triangles. In particular, the triangle formed by the front face of the body 10 and the two hinge plates 58 and 60 stably supports the hinge plate 34 in the Y-direction. Optionally, the whole framework of the hinge plates and the lever may be manufactured in one piece and may be cut out of a sheet of spring steel.

The lever 36 and the set-screw assembly 40 form an adjusting mechanism for adjusting the Z-position of the vertical hinge plate 32 and correspondingly the support point 26 of the mounting plate. When, for example, the left end of the lever 36 is moved downward by means of the set-screw assembly 40 (double arrow Z1), the lever will pivot about a fulcrum that is formed by the hinge 52, and the hinge plate 32 will be pushed downward. The downward movement of the support point 26 is permitted by a slight elastic flexing of the hinges of the horizontal hinge plate 34. In this way, the Z-position, and only the Z-position; of the support point 26 can be adjusted with a high degree of accuracy.

The hinge portions of the various hinge plates 32, 34, 58 and 60 also have the function of limiting the heat flow from the mounting plate 12 to the body 10 and thereby to thermally insulate the mounting plate 12.

Figure 4:
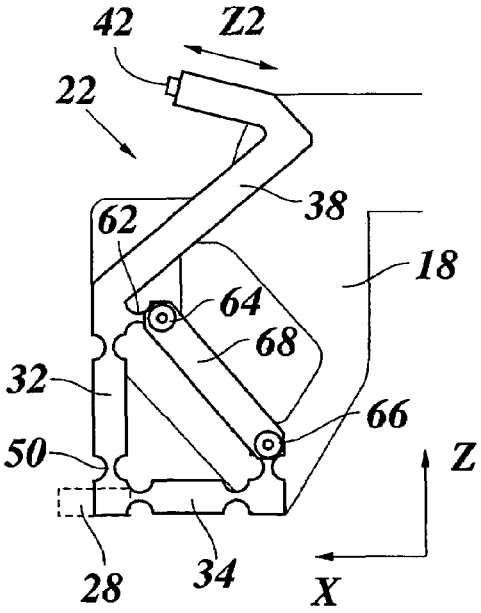
FIGS. 4 and 5 are views of adjusting units as seen in the direction of arrows IV-IV and V-V, respectively, in FIG. 3.

The adjusting unit 22, shown in FIG. 4, for the support point 28 of the mounting plate is based on the same functioning principles as the adjusting unit 20. Here, the top of the hinge plate 32 is connected, through a laterally offset hinge 62, to a fixation point 64 on the cantilever arm 18. Similarly, one end of the horizontal hinge plate 34 is connected to a fixation point 66 through another hinge. The fixation points 64 and 66 are rigidly connected by a metal link 68, so that a stable triangular frame is formed together with the hinge plates 32 and 34, even when the body 10 and its cantilever arms 18 are made of plastic and have a relatively low rigidity. The lever 38 is connected to the top end of the vertical hinge plate 32. When the set-screw assembly 42 is used to move the top end of the lever 38 in the direction indicated by a double-arrow Z2, the lever will pivot about a fulcrum formed by the hinge 62, and the hinge plate 32 will be pushed up and down, so that the Z-position, and only the Z-position, of the support point 28 can be adjusted with high accuracy.

Figure 5:
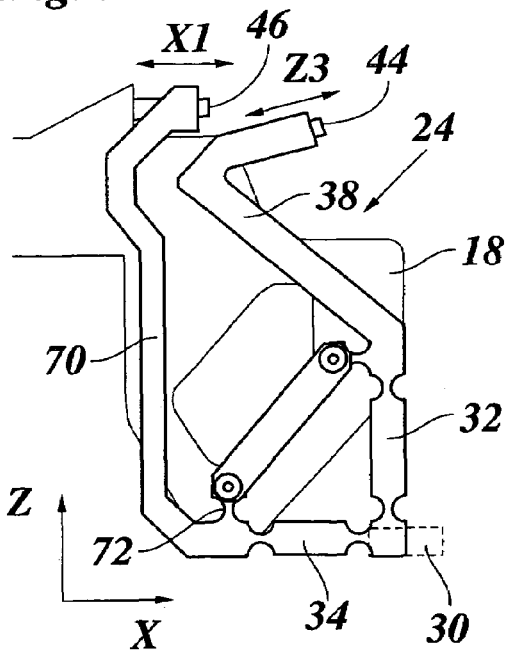

FIG. 5 shows the adjusting unit 24 for the support point 30 of the mounting plate. This adjusting unit has basically the same construction as the adjusting unit 22, and those components which have been described already are designated by like reference numerals and will not be described again. Adjustment in Z-direction is here achieved by means of the set-screw assembly 44 and the lever 38.

The set-screw assembly 46 serves to pivot a lever 70 about a fulcrum that is formed by a hinge 72, so that the horizontal hinge plate 34, that is connected to one end of the lever 70, will be pushed in the X-direction. It should be noted that, since the hinge plates 32 and 34 are oriented at right angles relative to one another, an adjustment of the support point 30 in the X-direction has no influence on the Z-position, and vice versa.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

The invention claimed is:

1. A printhead carriage comprising a body that is guided and driven for reciprocating movement in a printer, a mounting plate for a printhead assembly, and a suspension structure adjustably connecting the mounting plate to the body, the suspension structure comprising a framework of hinge plates having elastic hinges that are formed by reduced-width portions of the hinge plates and at least one adjusting mechanism adapted to adjust the position of the mounting plate by elastically deflecting at least one of the hinges, wherein an adjusting unit for at least one degree of freedom of the mounting plate comprises two hinge plates that are connected to a common support point of the mounting plate and are oriented at right angles relative to one another, and the adjusting mechanism is adapted to push and/or pull one hinge plate in the longitudinal direction thereof, with an elastic deflection of at least one hinge of the other hinge plate.

2. The printhead carriage according to claim 1, wherein the hinge plates are made of metal, preferably of spring steel.

3. The printhead carriage according to claim 1, wherein the suspension structure is adapted to adjust the mounting plate in at least two degrees of freedom.

4. The printhead carriage according to claim 1, wherein the adjusting unit for two degrees of freedom of the mounting plate comprises two hinge plates connected to a common support point of the mounting plate and oriented at right angles relative to one another, and two adjusting mechanisms, each of which is adapted to push and/or pull one of the two hinge plates in the longitudinal direction thereof, with an elastic deflection of at least one hinge of the respective other hinge plate.

5. The printhead carriage according to claim 1, wherein the adjusting mechanism comprises a lever which is connected to one end of the hinge plate and is connected to the body by a hinge that is operatively connected to the hinge plate, but laterally offset therefrom, and a mechanism for pivoting the lever about the hinge connected to the body.

6. The printhead carriage according to claim 1, wherein the ends of the two hinge plates remote from the common support point are connected by a link forming a triangular framework together with the hinge plates.

7. The printhead carriage according to claim 6, wherein said link has two elastic hinges connecting both ends of the link to the hinge plates.

8. The printhead carriage according to claim 1, wherein each of the hinge plates has two hinges located near opposite ends thereof.

9. The printhead carriage according to claim 1, wherein the mounting plate is a rectangular plate having two support points projecting from opposite ends thereof, and a third support point laterally projecting from the mounting plate, and an adjusting unit is associated with each of said support points.

10. The printhead carriage according to claim 9, wherein the suspension structure is adapted to hold the mounting plate in a position offset from the body in a direction normal to the plane of the mounting plate; and the suspension structure comprises two cantilever arms projecting from the body and embracing the mounting plate; two adjusting units are attached to respective ones of the cantilever arms; and a third adjusting unit is attached to a front face of the body and comprises a V-shaped arrangement of hinge plates that are attached to the body and the vertex of which is level with the mounting plate and supports one of the hinge plates that is connected to the support point of the mounting plate.

* * * * *